US009931538B2

(12) United States Patent
Levine

(10) Patent No.: US 9,931,538 B2
(45) Date of Patent: Apr. 3, 2018

(54) KICK BOXING TRAINING DEVICE

(71) Applicant: Ren Joseph Levine, Forestville, CA (US)

(72) Inventor: Ren Joseph Levine, Forestville, CA (US)

( * ) Notice: Subject to any disclaimer, the term of this patent is extended or adjusted under 35 U.S.C. 154(b) by 0 days.

(21) Appl. No.: 14/756,990

(22) Filed: Nov. 6, 2015

(65) Prior Publication Data

US 2017/0128774 A1 May 11, 2017

(51) Int. Cl.

| | |
|---|---|
| ***A63B 69/34*** | (2006.01) |
| ***A63B 23/035*** | (2006.01) |
| ***A63B 5/20*** | (2006.01) |
| ***A63B 21/00*** | (2006.01) |
| ***A63B 23/12*** | (2006.01) |
| ***A63B 21/04*** | (2006.01) |

(52) U.S. Cl.

CPC ..... *A63B 23/03541* (2013.01); *A63B 5/20* (2013.01); *A63B 21/00185* (2013.01); *A63B 21/0428* (2013.01); *A63B 21/153* (2013.01); *A63B 21/4035* (2015.10); *A63B 21/4043* (2015.10); *A63B 23/1209* (2013.01); *A63B 21/4003* (2015.10); *A63B 2244/102* (2013.01)

(58) Field of Classification Search

CPC ..... A63B 2244/10; A63B 2244/102; A63B 69/26; A63B 23/03533; A63B 23/03541; A63B 23/03516; A63B 21/00043; A63B 21/00185; A63B 21/0557; A63B 21/151; A63B 21/4019; A63B 21/4035; A63B 5/20; A63B 21/055; A63B 21/0552; A63B 21/153; Y10T 16/445; Y10T 16/4554; Y10T 16/4559; Y10T 16/4567; Y10T 16/4569; Y10T 16/4571; Y10T 16/469; Y10T 16/4724; Y10T 16/473; Y10T 16/476; B25G 1/10; B25G 1/102; B25G 33/12; B60N 3/02; B60N 3/023; B60N 3/026; A01K 27/003

USPC ..... 482/126; 119/796–798; 2/18; 434/247

See application file for complete search history.

(56) References Cited

U.S. PATENT DOCUMENTS 3,536,329 A * 10/1970 Edwards ..... A63B 69/3608 473/211
4,018,441 A * 4/1977 Greenberg ..... A63B 5/20 2/18
5,533,952 A * 7/1996 Schaber ..... A63B 22/0012 482/70
7,819,789 B2 * 10/2010 Berman ..... A63B 21/0004 482/121

(Continued)

*Primary Examiner* — Gregory Winter

(74) *Attorney, Agent, or Firm* — Christopher Peil; Law Office of Christopher Peil

(57) ABSTRACT

A kick boxing training device with a pair of D shaped handle members, a flexible cable and a ball member. The excess cable is capable of wrapping within the U shaped cross section portion of the D shaped handle. Each handle also includes a spring biased cable retaining assembly to hold the adjusted cable length in a fixed position. The ball shaped member includes a slidable cable retaining portion so that the cable is capable of being slid within the cable retaining portion. A person can trap the ball member between his or her chin and clavicle and then perform a punching action as he or she cycles between a left and a right hand punch motion. The cable can be extended and fixed in place so that the kick box training device can be used as a jump rope.

4 Claims, 6 Drawing Sheets

(56) References Cited

U.S. PATENT DOCUMENTS

| | | | | |
|---|---|---|---|---|
| 8,418,263 | B2 * | 4/2013 | McVan | A63B 69/0084 2/18 |
| 8,904,603 | B1 * | 12/2014 | Samuels | A63B 21/0557 16/428 |
| 8,998,779 | B1 * | 4/2015 | Ihli | A63B 21/00185 482/115 |
| 2010/0037433 | A1 * | 2/2010 | Walker | A63B 21/4017 16/421 |
| 2010/0041524 | A1 * | 2/2010 | McVan | A63B 21/154 482/108 |
| 2015/0072838 | A1 * | 3/2015 | Huang | A63B 71/145 482/83 |

* cited by examiner

KICK BOXING TRAINING DEVICE

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of exercise devices and more specifically to a kick boxing training device.

Kick boxing is a sport that is rapidly growing in popularity. In this sport, a person uses both arms and legs to attack an opponent. Part of the sport requires a punching action similar to that found in traditional boxing. The proper body position for the boxing action is that the head be kept down as the eyes peer forward and the arms cycle forward between a left punch and a right punch. As one hand extends out to punch, the other hand is supposed to pull into the chin area and vice versa. It would therefore be advantageous to have a training device that teaches a kick boxer the proper head location and proper reciprocating arm punching motion.

The present invention is a unique new training device that is designed to address two major components of kickboxing and boxing techniques:

- The first is that by holding the ball/cable guide under your chin, it trains you to keep your chin down in a tucked and defendable position.
- The second is that by adjusting the cable equal to the length of one extended arm, it forces the non-striking hand back to defend your face.

In other words, if you throw a punch with your left hand, the cable that is connected to the handle you are holding in each hand will force your right hand back to guard your face. If you do not bring your non-striking hand back to guard your face, the cable will pull the ball/cable guide out from underneath your chin. In my many years of kickboxing activity, I have witnessed coaches attempt to address this problem by having students hold ropes that are either around the back of their necks, or strung through their shirt sleeves. These methods were cumbersome, ineffective, and did not address the fighter keeping their chin down.

With the use of the spring biased cable clamp, one can adjust the cable to its full length to turn the invention into a speed rope that will help users improve their endurance, foot speed, and hand eye coordination. It should be noted that the present invention can be used as a training aid for conventional boxing as well as kick boxing.

BRIEF SUMMARY OF THE INVENTION

The primary object of the invention is to provide a kick box training device that helps the user develop proper hand and head location during a punching activity.

Another object of the invention is to provide a kick box training device that can be transformed into a jump rope.

Another object of the invention is to provide a kick box training device whose cord length can be easily altered.

A further object of the invention is to provide a kick box training device whose excess cord can be stored within the handles of the training device.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a kick boxing training device comprising: a pair of handle members, a flexible cable, a ball member, said handle members being D shaped in side view and U shaped in cross sectional view of both the straight portion and curved portion, said straight portion of the D shape is for hand gripping and the curved portion of the D shape is for storing excess cable wherein said cable is capable of wrapping within said U shaped cross section portion of said D shaped handle, said D shaped handle also including a spring biased cable retaining assembly capable of being released to adjust cable length and returned to retain said cable to the set length, said ball shaped member including a slidable cable retaining portion, said cable capable of being inserted into said cable retaining portion; where a person can trap said ball member between his or her chin and clavicle and then perform a punching action where said cable slides through said cable retaining assembly of said ball member and he or she cycles between a left hand punch motion and a right hand punch motion, and said cable capable of being extended so that said kick box training device can be used as a jump rope.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
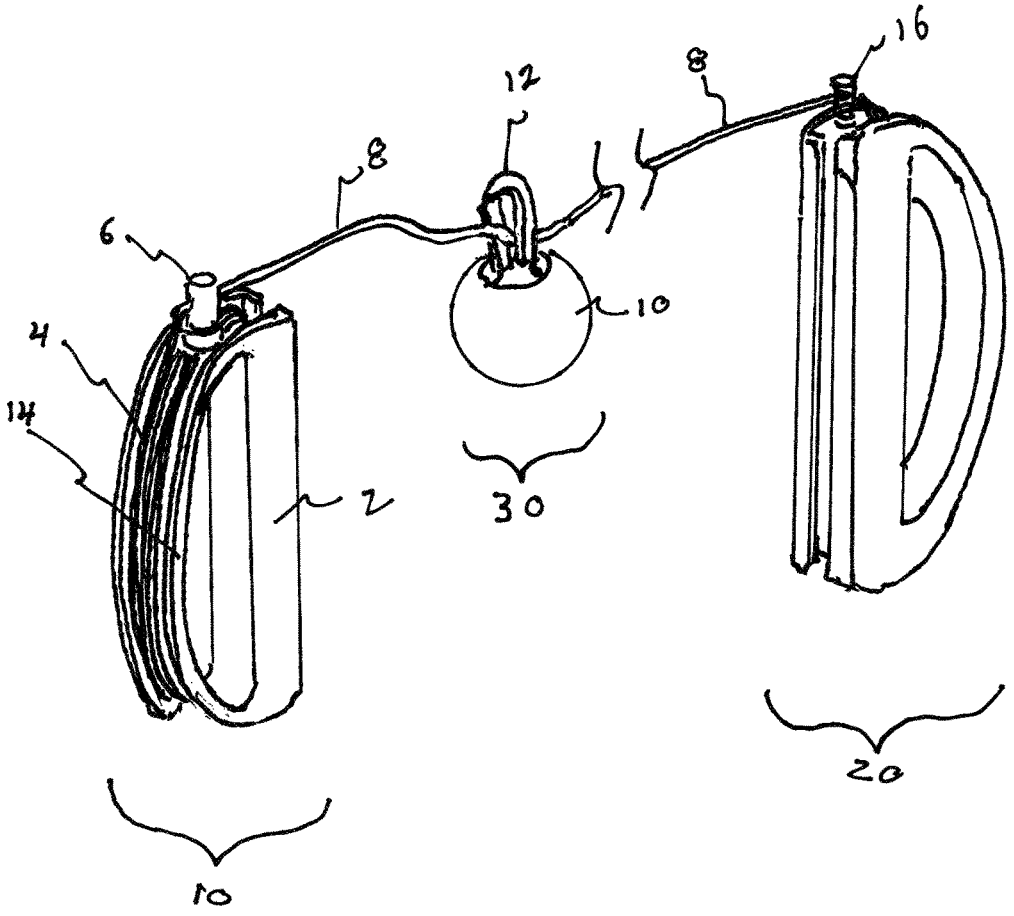
FIG. 1 is a perspective view of the invention.

Referring now to FIG. 1 we see a perspective view of the invention 100. Handle member 10 and handle member 20 are attached by cable 8. Cable 8 passes through aperture clip 12. Ball 30 is suspended from clip 12, forming ball assembly 30, so that it can rotate when necessary. Each handle 10, 20 is identical. Each handle 10, 20 is molded of rigid material such as polycarbonate and is D shaped where the curved portion 14 can store wound up cable 8 and the straight portion 2 is used for gripping. Cable 8 can be wound through the U shaped channel 18 in straight handle portion 2 and around the U shaped channel 4 in curved portion 14. Additional channel 22 (FIG. 5) is as thin as the cable and can frictionally retain the end portion of cable 8. Cable retainers 6, 16 capture cable 8 and hold it to the selected length. The cable length can be adjusted and set by retainers 6, 16 and remaining cable can be stored in the handles 10, 20 as described above. To adjust the cable length, the user pushes down on the retainer outer barrel, slides the cable to the desired length, and then releases the retainer barrel which is spring biased and caused to return to its gripping position. It should be noted that although the description of the invention 100 uses the term "kick boxing", the invention 100 can also be used as a training device for conventional boxing.

Figure 2:
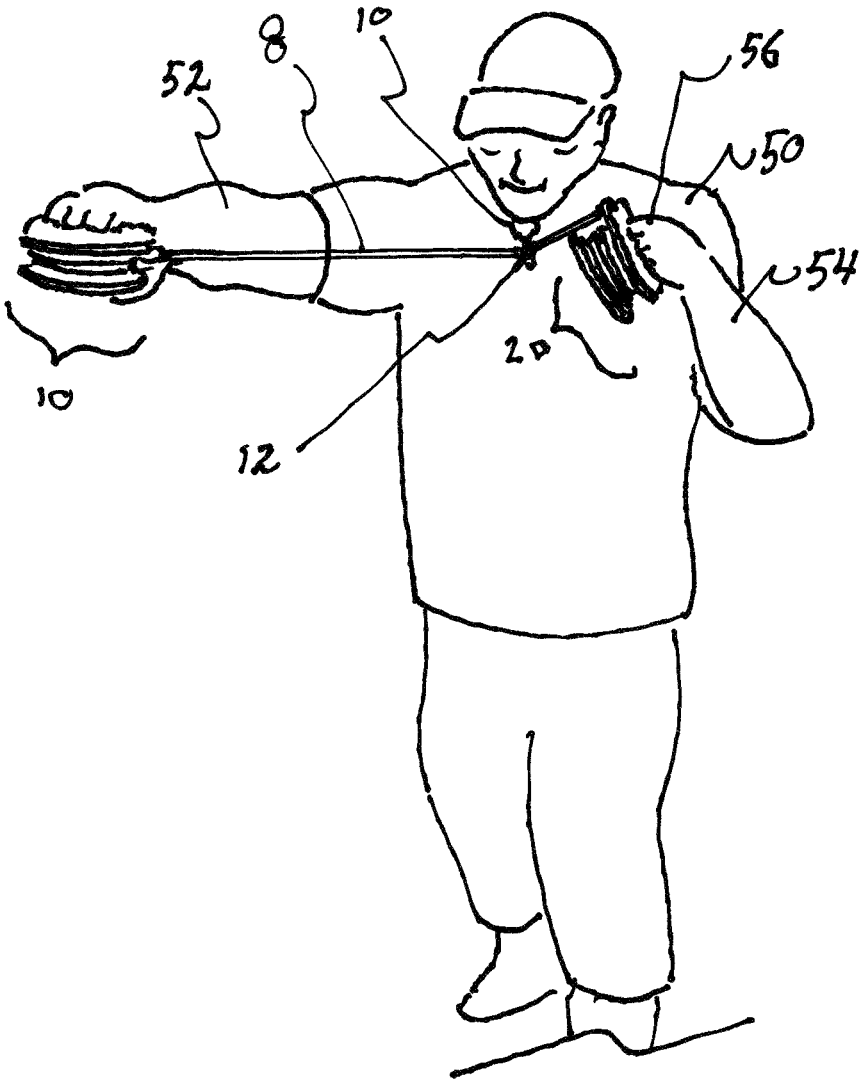
FIG. 2 is a perspective view of a person using the invention with right hand out.
Figure 3:
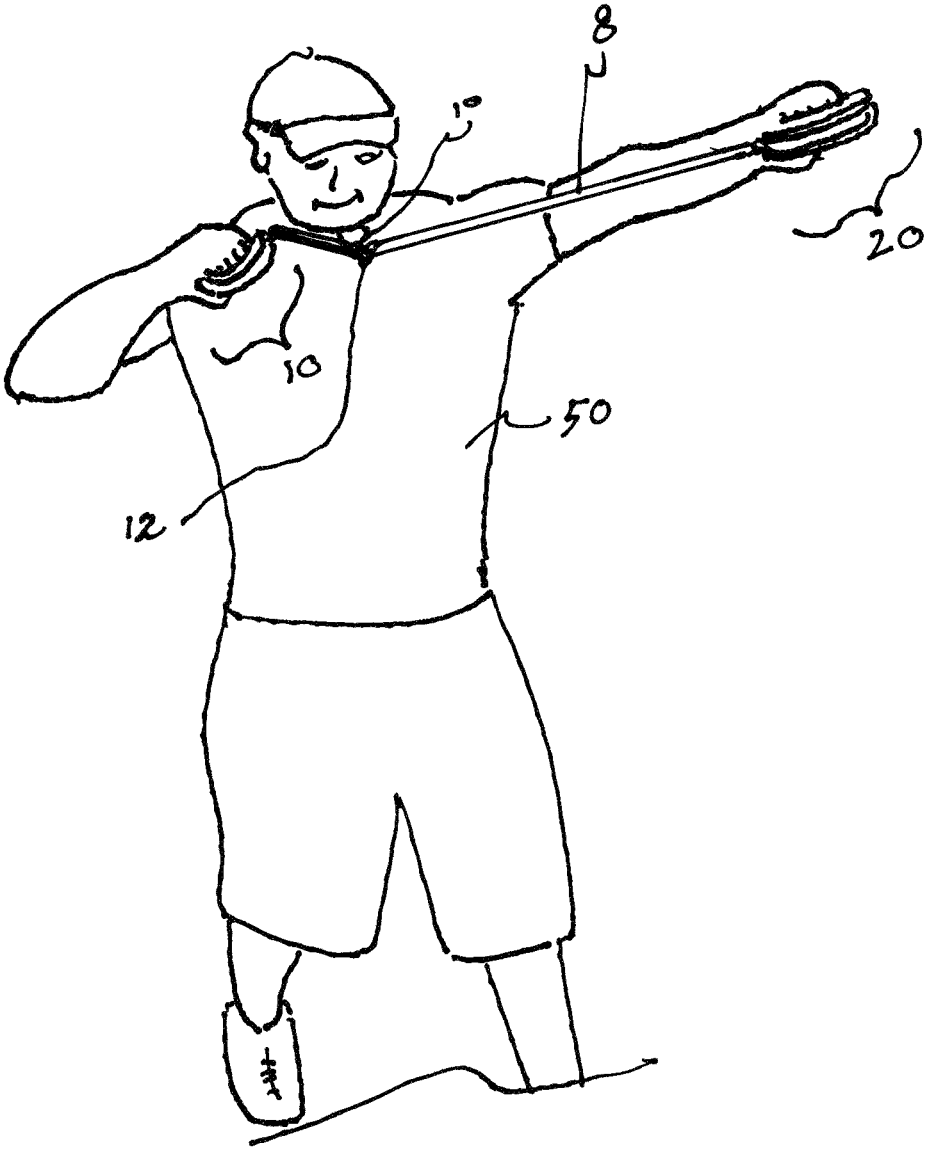
FIG. 3 is a perspective view of a person using the invention with the left hand out.

FIG. 2 is a perspective view of a person 50 using the present invention 100. For practicing proper boxing hand movements, the user 50 sets the length of the cable 8 so that the length is equal to the distance between one extended arm 52 and the location of the ball 10 under the chin and finally to the opposite arm 54 that is drawn in so that the hand 56 is in close proximity to the user's chin. The user then cycles back and forth from the position shown in FIG. 2 to the position shown in FIG. 3. All the while, the user is retaining the ball 10 between his chin and clavicle. In this way, the user gets into the habit of keeping his or her chin down, and forming the habit of drawing one hand in toward the face, while the other hand is extended in a punching mode.

Figure 4:
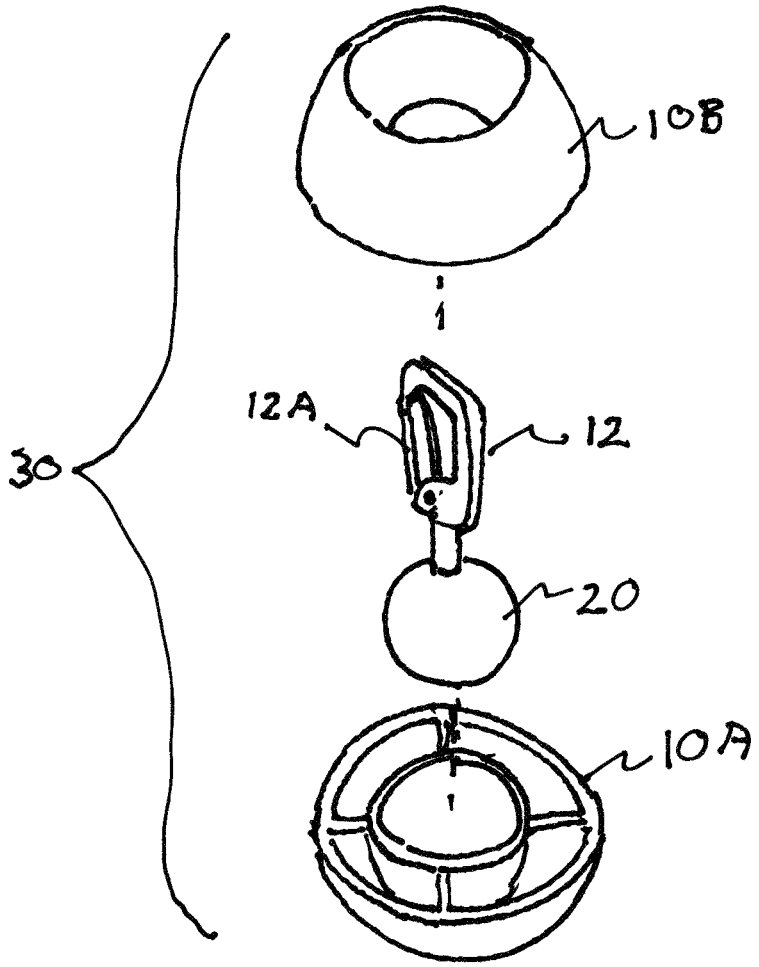
FIG. 4 is an exploded view of the ball portion of the invention.

FIG. 4 is an exploded view of the ball assembly 30. Inner ball 29 can swivel when it is captured between ball half 10A and ball halve 10B. Retaining clip 12 is build in a similar manner to a carabineer used in mountain climbing and includes a spring biased closure member 12A. The user pushes the cable 8 into the aperture formed by main clip 12 and clip closure member 12A. This allows the cable 8 to easily slide as it passes through the ball clip aperture. Cable 8 is made of stranded steel and coated with a vinyl sleeve. Additionally, Main clip 12 is sized so that the tip of the clip 12 can be used as a pick to remove the cable from the channel 22 that is used to frictionally retain the end of the cable 8.

Figure 5:
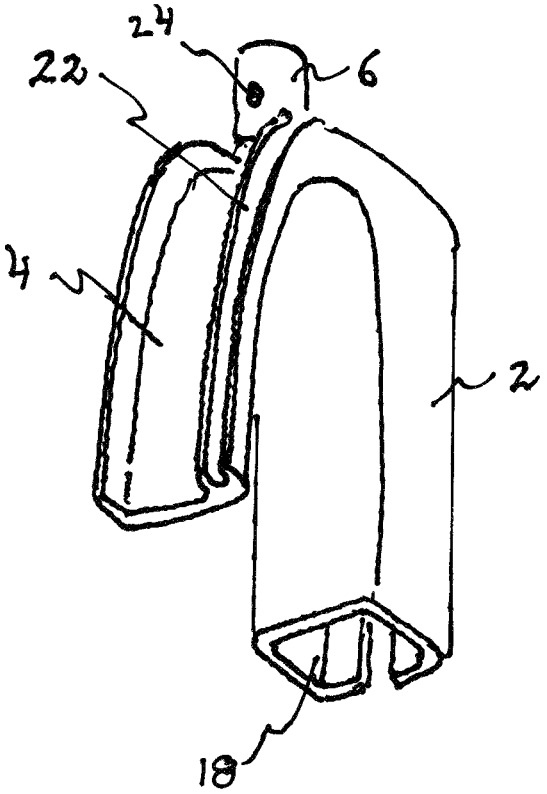
FIG. 5 is a section view of the handle of the invention.

FIG. 5 is a section view of a handle 10. This view clearly shows the U shaped trough 4 in curved portion 14 and trough 18 in straight handle portion 2 where cable 8 can be stored. Thin channel 22 is slightly smaller in width than the width of cable 8 and can be used to retain the end portion of cable 8. The cable 8 can be extended to over 6 feet to allow the present invention 100 to be used as a jump rope.

Figure 6:
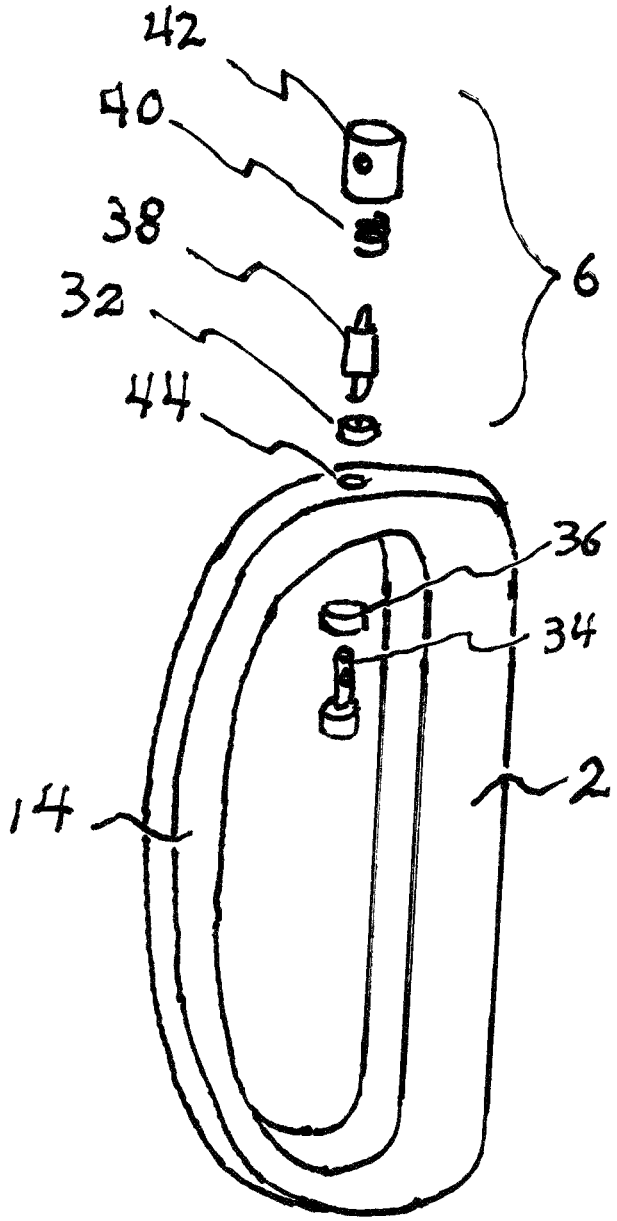
FIG. 6 is an exploded view of the spring biased cable retainer portion of the invention.

FIG. 6 is an exploded view of the cable retaining clamp 6. A central post 34 contains a horizontally disposed cable aperture and is retained in an opening 44 by nuts 36, 32. Sleeve 38 slides over post 34 and can rotate as needed during use. Outer sleeve 42 contains a horizontally disposed cable aperture 24 (FIG. 5) and is spring biased by compression spring 40. When the user pushes down on outer sleeve 42, apertures in sleeves 42 and 38 align so that he or she can slide the cable 8 to the desired length. When the outer sleeve 42 is released, it slides down to lock the cable in place.

The above training device 100 is easy to use and economical to manufacture. It can be adjusted to fit any boxer in training. The result is that a person training with the invention 100 will develop proper hand and punch motion. The user has the added benefit of being able to do jump rope exercise with the invention when so desired, if the ball member is eliminated.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A boxing training device comprising:

a pair of handle members;

a flexible cable;

a ball member;

each said handle member being D shaped and comprising a straight portion and a curved portion, said straight portion and said curved portion each comprising a U-shaped cross section;

wherein said straight portion is for hand gripping and said curved portion is for storing excess cable wherein said cable is capable of wrapping within said U shaped cross section portions of each said D shaped handle member;

each said D shaped handle member including a spring biased cable retaining assembly capable of being released to adjust a length of said cable and returned to retain said cable to a set length;

said ball member including a slidable cable retaining portion;

said cable capable of being inserted into said cable retaining portion and wherein a person can trap said ball member between his or her chin and clavicle and then perform a punching action wherein said cable slides through said cable retaining assembly of said ball member as he or she cycles between a left hand punch motion and a right hand punch motion; and said cable capable of being extended so that said boxing training device can be used as a jump rope.

2. The boxing training device as claimed in claim 1 wherein said cable is made of vinyl coated steel.

3. The boxing training device as claimed in claim 1 wherein said D shaped handle members are made of injection molded rigid plastic.

4. The boxing training device as claimed in claim 1 wherein said cable retaining portion of said ball member can swivel within said ball member to allow said ball member to rotate during training activity.

* * * * *